United States Patent [19]

Shiibayashi

[11] Patent Number: 4,648,814

[45] Date of Patent: Mar. 10, 1987

[54] SCROLL FLUID MACHINE WITH OIL INJECTION PART AND OIL RELIEVING PASSAGE

[75] Inventor: Masao Shiibayashi, Shimizu, Japan

[73] Assignee: Hitachi, Ltd., Tokyo, Japan

[21] Appl. No.: 731,913

[22] Filed: May 8, 1985

[30] Foreign Application Priority Data

May 25, 1984 [JP] Japan ..... 59-104514

[51] Int. Cl.[4] ..... F04C 18/04; F04C 29/02

[52] U.S. Cl. ..... 418/55; 418/97

[58] Field of Search ..... 418/55, 57, 97, 99

[56] References Cited

U.S. PATENT DOCUMENTS 3,884,599 5/1975 Young et al. ..... 418/55

4,314,796 2/1982 Terauchi ..... 418/55

FOREIGN PATENT DOCUMENTS 55-148994 11/1980 Japan .

56-85087 7/1981 Japan .

57-8386 1/1982 Japan ..... 418/55

58-170876 10/1983 Japan ..... 418/97

*Primary Examiner*—John J. Vrablik

*Attorney, Agent, or Firm*—Antonelli, Terry & Wands

[57] ABSTRACT

A scroll fluid machine has a stationary scroll member and an orbiting scroll member each having an end plate and a spiral wrap. At least one oil injection port and at least one oil relieving passage is formed in the end plate of either one of the scroll members. The oil injection port opens into at least one of the enclosed spaces, while the oil relieving passage provides an intermittent communication between that enclosed space and a space or chamber of an intermediate pressure formed by the scroll members which includes a suction chamber.

1 Claim, 9 Drawing Figures

SCROLL FLUID MACHINE WITH OIL INJECTION PART AND OIL RELIEVING PASSAGE

BACKGROUND OF THE INVENTION

The present invention relates to an oil injection type scroll fluid machine suited for a refrigeration compressor for air conditioning, a cryogenic helium refrigerator or an air compressor.

Generally, a scroll fluid machine includes an orbiting scroll member having an end plate and a vertical wrap extending from one surface of the end plate and formed along an involute curve or a curve which approximates to an involute curve, and a stationary scroll member, of a similar construction provided with a discharge port and a suction port formed in a central and an outer peripheral portion of the end plate. The orbiting scroll member and the stationary scroll member are brought together in such a manner that the wraps thereof mesh with each other.

An Oldham's mechanism is disposed between the orbiting scroll member and the stationary scroll member or a frame carrying the stationary scroll member so as to prevent the orbiting scroll member from rotating about its own axis. An eccentric pin on a rotary shaft engages with the orbiting scroll member through a bearing.

In operation, the eccentric pin revolves as the rotary shaft is driven so that the orbiting scroll member makes an orbital movement without rotating about its own axis, whereby a gas is drawn into and compressed in enclosed compression spaces formed by the walls of the wraps and the end plates of both scroll members. This type of scroll fluid machine is shown, for example, in the specification of U.S. Pat. No. 3,884,599.

During the operation of the scroll fluid machine of the aforementioned type gas under compression in the enclosed spaces between both scroll members produces a force which acts to separate both scroll members in the axial direction and the tendency of both scroll members to move away from each other will cause a leak or by-passing of the gas under compression to a lower pressure space thereby adversely affecting the compression performance.

In order to avoid the above-noted problem, in, for example, Japanese Laid Open Patent Application No. 55-148994, it has been proposed to apply a gas pressure to the back side of the end plate of the orbiting scroll member so as to axially press the orbiting scroll member onto the stationary scroll member. For this purpose a part of the gas of an intermediate pressure between the suction pressure and the discharge pressure is extracted or withdrawn and introduced to the back side of the orbiting scroll member so as to obtain the axial pressing force, thereby attaining a high sealing effect between both scroll members.

In, for example, Japanese Laid Open Patent Application No. 56-85087, scroll fluid machine is proposed wherein an oil is injected into an enclosed space or spaces formed between both scroll members, in order to cool the gas under compression during the operation of the machine.

A disadvantage of the above-noted scroll fluid machine resides in the fact that when the scroll fluid machine is being started up or is going to be stopped, the oil undesirably fills the enclosed space or spaces adapted to be injected thereby resulting in a risk of breakdown of the scroll wraps due to liquid compression, or a forcible moving of the orbiting scroll member from the stationary scroll member due to an abnormal rise of the internal pressure in the enclosed space or spaces, resulting in a compression and starting failure.

SUMMARY OF THE INVENTION

Accordingly, an object of the invention is to provide an oil injection type scroll fluid machine which avoids the above-noted problems relating to liquid compression and starting failure.

According to the invention, a scroll fluid machine is provided having at least one oil injection port formed in the end plate of the stationary scroll member or the orbiting scroll member so as to open into one of enclosed compression spaces formed between both scroll members, and at least one oil relief passage for allowing the one of the enclosed compression spaces to be intermittently communicated with a chamber which is maintained under an intermediate pressure.

According to the present invention, the oil injected into the enclosed compression space for the purpose of cooling the gas and filling the enclosed space when the compressor is being started or stopped is allowed to escape through the oil relief passage into a chamber of an intermediate pressure including the suction chamber.

Consequently, it is possible to avoid the extraordinary pressure rise in the compression space and, hence, a starting failure due to increase in the starting torque which may otherwise be caused by liquid compression thereby ensuring a smooth start up of the fluid machine.

DESCRIPTION OF THE PREFERRED EMBODIMENTS

Preferred embodiments of the invention will be described hereinunder with reference to the accompanying drawings.

Figure 1:
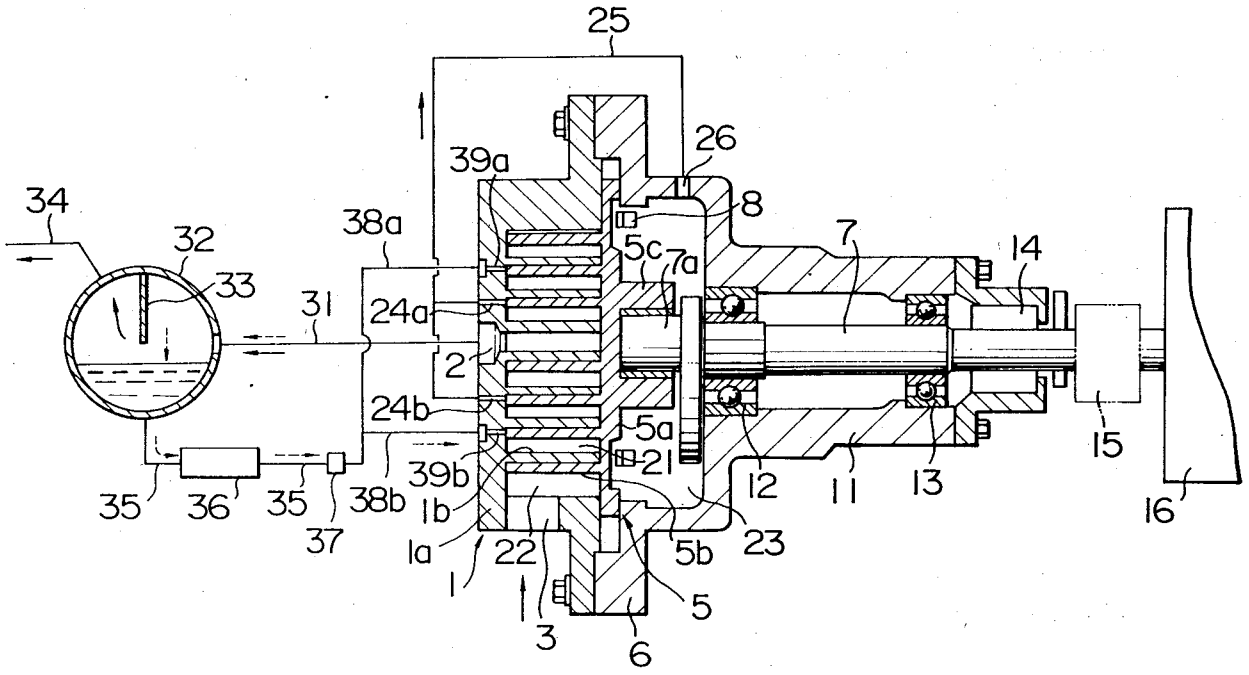
FIG. 1 is a vertical sectional view of an embodiment of a scroll fluid machine in accordance with the invention.

Referring now to the drawings wherein like reference numerals are used throughout the various views to designate like parts and, more particularly, to FIG. 1, according to this figure, a scroll fluid machine such as, for example, a horizontal air compressor having a horizontally extending crankshaft includes a stationary scroll member generally designated by the reference numeral 1 having an end plate 1*a* and a spiral wrap 1*b* extending from an upper surface of the end plate 1*a* with a discharge port 2 and a suction port 3 being formed in a central portion and an outer peripheral portion of the end plate 1*a*. An orbiting scroll member generally designated by the reference numeral 5 includes an end plate 5*a* and a spiral wrap 5*b* extending from the end plate 5*a*, with the stationary scroll member 1 and the orbiting scroll member 5 being assembled so that the wraps 1*b*, 5*b* mesh with each other. The orbiting scroll member 5 is disposed in a space between the stationary scroll member 1 and an outer frame 6 to which the stationary scroll member 1 is fixed. Bearings 12, 13 are provided in a central cylindrical portion 11 for supporting a rotary shaft 7.

An eccentric pin 7*a* on the end of the rotary shaft 7 is rotatably received in a bore formed in a boss 5*c* which is provided on the orbiting scroll member 5. An Oldham's mechanism 8 including an Oldham's key and ring is disposed between the outer frame 6 and the orbiting scroll member 5, so that, as the eccentric pin 7*a* revolves, the orbiting scroll member 5 makes an orbiting motion with respect to the stationary scroll member 1 without rotating about its own axis.

A shaft seal 14 is provided within the central cylindrical portion 11 of the frame 6 at one side of the bearing 13. The rotary shaft 7 extends to the outside of the central cylindrical portion and is connected to an electric motor 16 through a shaft coupling 15.

The orbiting motion of the orbiting scroll member 5 causes enclosed spaces or compression spaces 21 formed between both scroll members to move toward the center while progressively decreasing the volume thereof. A gas is drawn into a suction chamber 22 through the suction port 3 and is then progressively compressed in the enclosed spaces 21 until discharged through the discharge port 2.

A back pressure chamber 23, defined on a back side of the end plate 5*a* of the orbiting scroll member 5 by the back surface of the end plate 5*a* and a part of the outer frame 6 is communicated with the enclosed spaces at the midway point of the compression stroke through ports 24*a*, 24*b*, pipe 25 and an opening 26, so that an intermediate pressure, being built up in the course of compression, is introduced into the back pressure chamber 23. This intermediate pressure produces an axial force which acts to press the orbiting scroll member 5 axially onto the stationary scroll member 1.

When the gas handled by the scroll fluid machine is air or helium gas, the compressed gas leaving the discharge port 2, has a high temperature which easily reaches 300° to 500° C. due to the high compression (adiabatic) index thereof. Therefore, a system is associated with the compressor to inject an oil into the enclosed spaces under compression, thereby cooling the compressed gas.

A discharge pipe 31 leading from the discharge port 2 is connected to an oil separator 32 having a separator plate 33. A delivery pipe 34 is connected to the oil separator 32 at an upper portion thereof so that the gas after the oil separation flows through the delivery pipe 34. An oil pipe 35 connected to the bottom of the oil separator 32 leads through an oil cooler 36 and an oil flow rate regulating orifice 37 to branched oil injection pipes 38*a*, 38*b* which are connected to oil injection ports 39*a*, 39*b* formed in the end plate 1*a* of the stationary scroll member 1. The oil injection ports 39*a*, 39*b* open into enclosed spaces in the compression stroke. In the drawings, solid line arrows show the flow of the gas, while broken line arrows show the flow of the oil.

The gas pressure relieving ports 24*a*, 24*b* and the oil injection ports 39*a*, 39*b* are arranged in pairs at symmetrical positions along the scroll wrap wall under the same pressure condition, respectively.

Figure 2:
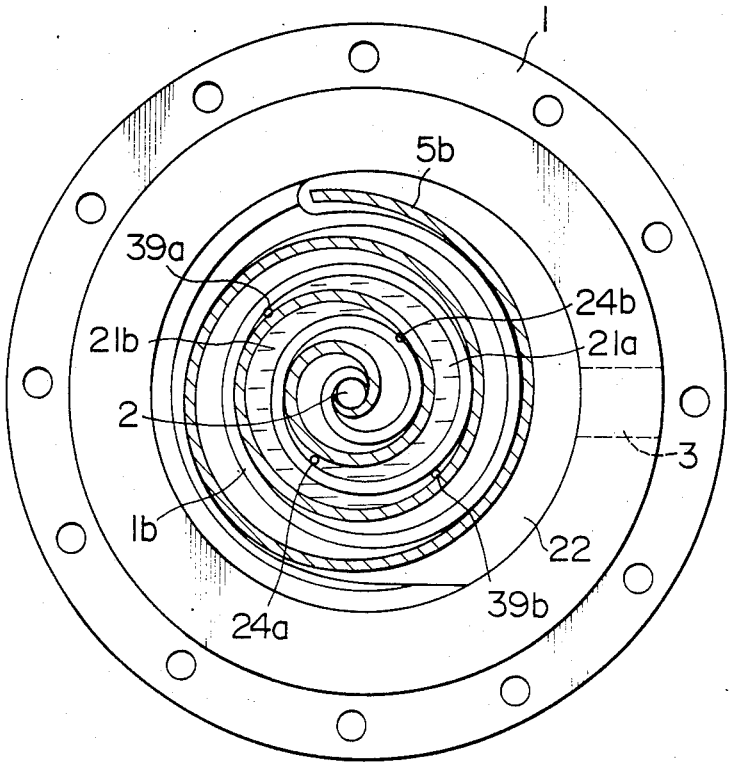
FIG. 2 is a cross-sectional view of a part of the scroll fluid machine shown in FIG. 1, illustrating in particular the state of meshing of wraps.

As shown in FIG. 2, the positions of the gas pressure relieving ports 24*a*, 24*b* and the positions of the oil injecting ports 39*a*, 39*b* are so selected that the corresponding ports are intermittently communicated with each other through the enclosed spaces 21*a*, 21*b* formed by both scroll members.

More specifically, the oil injection ports 39*a*, 39*b* are disposed at positions which are within one turn of the wrap from the positions of the gas pressure relieving ports 24*a*, 24*b* towards the terminating ends (outer ends) of the wraps, respectively, so that the ports 39*a*, 39*b* are allowed to communicate with the ports 24*a*, 24*b* intermittently, i.e., at least once in one orbiting cycle of the orbiting scroll member, through the above-mentioned enclosed spaces 21*a*, 21*b*.

The positional relationship between the gas pressure relieving ports and the oil injection ports is expressed as follows:

$$\lambda_b < \lambda_{oin} < \lambda_b + 2\pi \quad (1)$$

where, $\lambda_{oin}$: position of oil injection port in terms of scroll wrap angle (rad)

$\lambda_b$: position of gas pressure relieving port in terms of scroll wrap angle (rad)

$\pi$: circumference of circle to diameter ratio

The term scroll wrap angle represents the involute angle when the wrap is formed in accordance with an involute curve. In FIG. 2, the positions of the oil injecting ports 39*a*, 39*b*, formed in the end plate 1*a* of the stationary scroll member 1, are expressed as $\lambda_{oin} \approx 12.8$ rad, while the positions of the gas pressure relieving ports 24*a*, 24*b* are expressed as $\lambda_b \approx 8.8$ rad. The relationship between the above positions of the ports satisfies the condition of the formula (1), so that the oil injection ports 39*a*, 39*b* are allowed to intermittently communicate with gas relieving ports 24*a*, 24*b* through the enclosed spaces 21*a*, 21*b*, respectively.

The oil charged into the enclosed spaces for the purpose of cooling the compressed gas fills the spaces when the compressor is going to be started or stopped. According to the invention, however, the oil filling the enclosed spaces has a fair chance of escape into the back pressure chamber 23 through the gas pressure relieving ports 24*a*, 24*b*.

Figure 3:
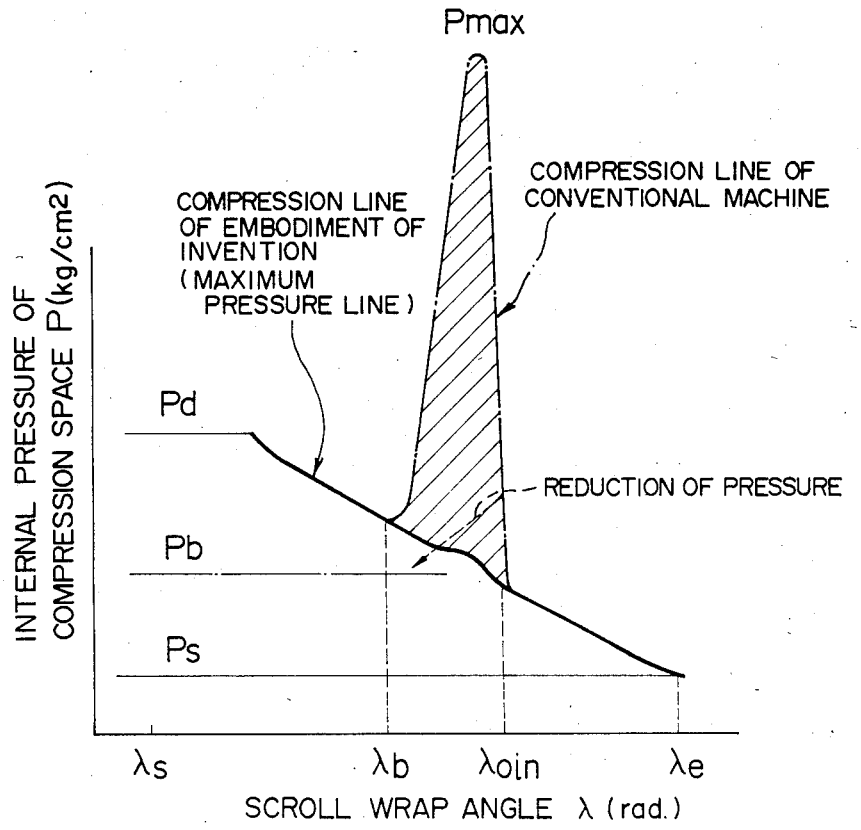
FIG. 3 is a pressure indicator diagram (P-λ diagram) showing the change in enclosed compression spaces of the machine shown in FIG. 1.

FIG. 3 graphically illustrates a pressure diagram in the initial starting period of the invention, in comparison with a conventional scroll fluid machine having no oil relieving passage. In FIG. 3, the pressures in the invention and in the conventional machine are shown by solid-line and dot-and-dash curves, respectively. The abscissa represents the scroll wrap angle $\lambda$ in place of the volume V of the enclosed space. Symbols $\lambda_s$ and $\lambda_e$ represent, respectively, the starting end and terminating end of the scroll wrap.

With the conventional scroll fluid machine, the internal pressure shows an abnormal rise to a level Pmax much higher than the discharge pressure Pd, due to compression of oil which is incompressible. In the scroll fluid machine of the invention, however, the enclosed spaces 21*a*, 21*b* are not perfectly closed but are intermittently communicated with the gas pressure relieving ports 24*a*, 24*b*. Therefore, the oil filling the enclosed spaces is allowed to flow into the back pressure chamber 23 maintaining a pressure lower than the maximum pressure Pd to reduce the internal pressure of the enclosed spaces, so that the abnormal pressure rise in the enclosed spaces 21*a*, 21*b* is advantageously avoided. Needless to say, the relationship between the pressure $P_b$ in the back pressure chamber 23 and the maximum pressure $P_{max}$ can be expressed as $P_b << P_{max}$. The area surrounded by the indicated pressure diagram corresponds to the power required for the driving of the machine. According to the invention, the starting torque can be sufficiently lowered because of the elimination of the extraordinary pressure rise in the enclosed spaces due to compression of oil. Although in the above described embodiment the gas pressure relieving ports 24*a*, 24*b* are formed in the end plate 1*a*, as readily apparent, the same result can be obtained when the pressure relieving ports 24*a*, 24*b* are formed in the corresponding portions of the end plate 5*a* of the orbiting scroll member 5.

In the embodiment described hereinabove, the pairs of ports: namely, the gas pressure relieving port 24*a* and the oil injection port 39*a*, and the gas pressure relieving port 24*b* and the oil injection port 39*b*, are arranged in symmetry in regard to the pressure condition. This, however, is not exclusive and the advantages of the invention can be attained practically even with only one pair of ports.

Preferably, the gas pressure relieving ports 24*a*, 24*b* have a diameter which is smaller than the thickness of the wrap 1*b* or 5*b*.

Figure 4:
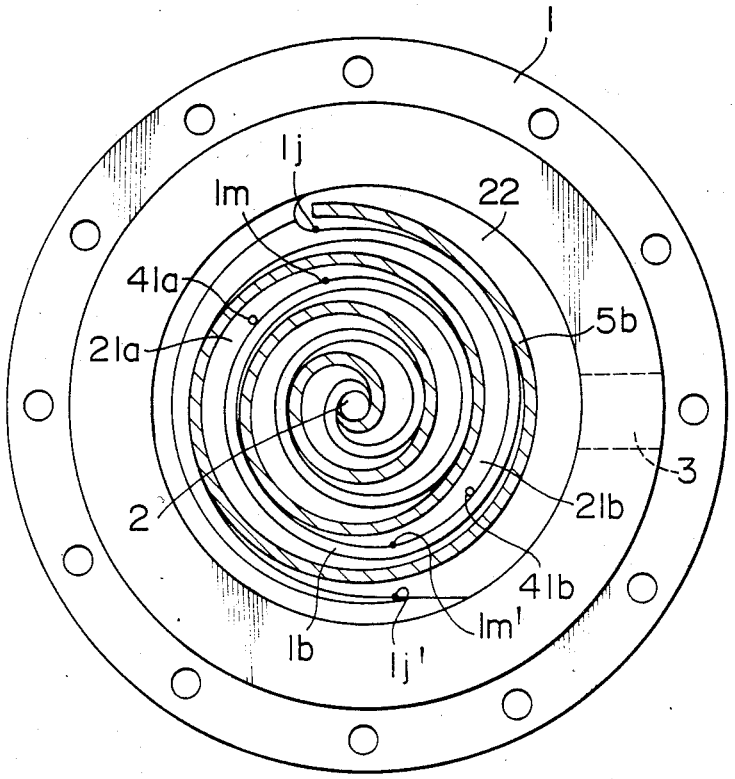
FIG. 4 is a cross-sectional view of a part of another embodiment of the scroll fluid machine, showing in particular the state of meshing of scroll wraps.

In FIG. 4, oil injection ports 41*a*, 41*b* are formed in the end plate of the stationary scroll member along the wrap wall at positions which are within one turn of the wrap from the terminating ends of the inner and outer surfaces of the wrap wall, so that the enclosed spaces into which the oil is injected are allowed to intermittently communicate with a wrap space which is intermittently brought into communication with the suction chamber.

In this embodiment, the positions of the oil injection ports are selected to meet the following condition:

$$\lambda_{oin} > \lambda_e - 2\pi \quad (2)$$

where, $\lambda_e$: angle of terminating end of scroll warp (rad)

$\lambda_{oin}$: position of oil injection port in terms of scroll wrap angle (rad)

$\pi$: circumference of circle to diameter ratio

From FIG. 4, it will be seen that the oil injection ports 41*a*, 41*b* are formed in the end plate 1*a* of the stationary scroll member 1 at positions which are less than one turn (about 0.9 turn) of the wrap as measured from the terminating ends 1*j*, 1*j'* of the outer and inner wall surfaces of the wrap 1*b* towards the starting end (center) of the wrap, respectively.

According to this arrangement, the oil injected into the enclosed spaces is intermittently relieved to the suction chamber of the compressor, so that the amount of oil injected into the enclosed spaces 21*a*, 21*b* is decreased to suppress the tendency for liquid compression to take space in these spaces.

The spaces into which the oil injection ports 41*a*, 41*b* open and which are intermittently communicatable with the suction space are spaces which intermittently constitute spaces under suction stroke and which thereafter constitute compression chambers as the orbiting scroll member continues to orbit.

In regard to the formula (2), the positions of the oil injection ports 41*a*, 41*b* are preferably selected to meet the following condition, from a practical point of view:

$$\lambda_{oin} \approx \lambda_e - 2\pi + (\pi/6 \text{ to } \pi/4) \quad (3)$$

Figure 5:
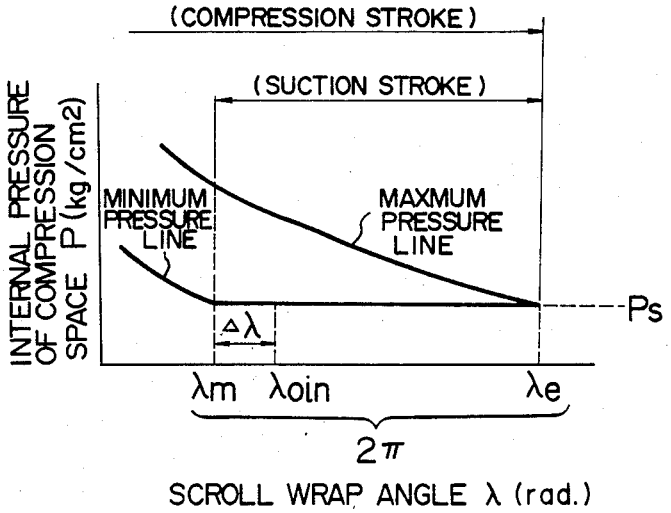
FIG. 5 is a pressure indicator diagram (P-λ diagram) showing the change in the pressure within enclosed compression spaces of the embodiment shown in FIG. 4.

In FIG. 5, a symbol $\lambda_m$ represents the scroll wrap angle of the suction stroke completing positions 1*m*, 1*m'* as shown in FIG. 4. Therefore, the time duration of oil injection in the suction stroke, i.e., the period during which the space communicating with the suction chamber is allowed to communicate with the oil injection ports 41*a*, 41*b* is represented by the contact region which is given as follows:

$$\Delta\lambda = \lambda_{oin} - \lambda_m \quad (4)$$

where, $\Delta\lambda$: contact region in terms of scroll wrap angle (rad) corresponding to the period of oil injection in the suction stroke.

$\lambda_{oin}$: position of oil injection port in terms of scroll wrap sngle (rad)

$\lambda_m$: positions of points 1*m*, 1*m'* of contact between both scrolls in terms of scroll wrap angle (rad) at the time of completion of the suction stroke (rad)

Referring to the formula (3) and (4), the contact region $\Delta\lambda$ corresponding to the oil injection period generally meets the condition of $\Delta\lambda = (\pi/6 \text{ to } \pi/4)$. Thus, the oil injection ports 41*a* and 41*b* are allowed to communicate intermittently during the period $\Delta\lambda$ (rad) with the space which is held in communication with the suction chamber, in each rotation of the rotary shaft.

Practically, the period in terms of wrap angle during which the ports 41*a*, 41*b* are communicated with the suction space before isolation from the suction port is considered to be equivalent to about 30° to 45° in each rotation of the rotary shaft.

In the embodiment of FIG. 4, the oil injection ports 41*a*, 41*b* are disposed at such positions that they are allowed to intermittently communicate with the suction space which is still maintained in communication with the suction port, so that the drawn-in gas can be cooled effectively, and in addition to the prevention of liquid compression the performance during steady operation is improved by virtue of an increase in the charging efficiency.

The effect of cooling of the gas will be explained in detail hereinunder. The temperature of the drawn-in gas $T_s$ is about 20° to 30° C., but the gas temperature is raised as the gas enters the suction chamber 22, due to absorption of heat from the parts around this chamber. In the case of an open-type scroll compressor, the degree of internal heating of the gas easily well reaches about 20°-30° C. Therefore, the gas in the suction chamber 22 usually has a temperature $T_{s0}$ of about 50° C. That is, the gas has been heated up to the temperature $T_{s0}$ before it is sucked into the spaces formed by the scroll wraps.

On the other hand, the temperature $T_{oil}$ of the oil which is being injected from the oil injection ports 41a, 41b is about 20° C. when a water-cooled type oil cooler (not shown) is used and is about 45° C. when a air-cooled type oil cooler (not shown) is used. The oil having a temperature $T_{oil}$ lower than the suction gas temperature $T_{s0}$ naturally cools the sucked gas when injected into the gas.

Figure 6:
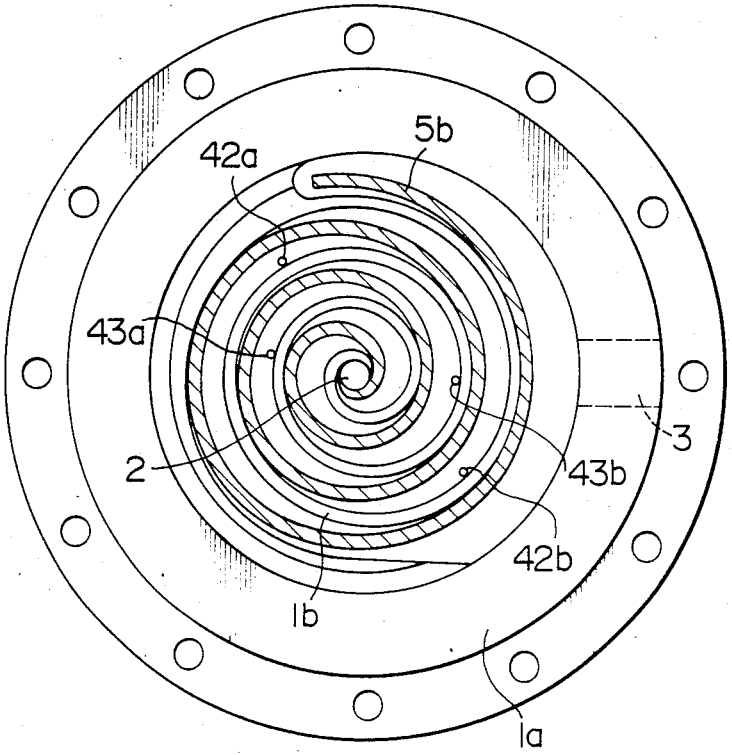
FIG. 6 is a cross-sectional view of a part of still another embodiment of the scroll fluid machine, showing in particular the state of meshing of scroll wraps.

FIG. 6 shows still another embodiment of the invention in which the positional relationship between oil charging ports and gas pressure relieving ports is determined as a compromise between the embodiments shown in FIGS. 2 and 4.

The positions of the oil injection ports 42a, 42b and gas pressure relieving ports 43a, 43b formed in the end plate 1a of the stationary scroll member or the end plate 5a of the orbiting scroll member are determined to meet the following relationship:

$$\lambda_b+2\pi>\lambda_{oin}>\lambda_e-2\pi \quad (5)$$

where, $\lambda_b$: position of gas pressure relieving port in terms of scroll wrap angle (rad)

$\lambda_{oin}$: position of oil injection port in terms of scroll wrap angle (rad)

$\lambda_e$: scroll wrap angle at the terminating end of scroll wrap (rad)

Thus, in embodiment of FIG. 6, the oil injection ports 42a, 42b are formed along the wrap wall at positions which are within one turn of the wrap as measured from the terminating ends of the inner and outer wall surfaces of the wrap, whereas, the gas pressure relieving ports 43a, 43b are formed at positions which are within one turn of the wrap from the positions of the oil injection ports 42a, 42b towards the wrap starting end (inner end).

According to this arrangement, the oil injection ports 42a, 42b can intermittently communicate with the working space before isolation from the suction port and also with the gas pressure relieving ports 43a, 43b through enclosed spaces.

Since the oil is intermittently injected into the working space before the isolation of this working space from the suction port, the gas under suction stroke can be cooled effectively. In addition, the oil filling the enclosed spaces at the time of starting or stopping of the machine can escape to the back pressure chamber, thus avoiding undesirable liquid compression.

In the illustrated case, the values $\lambda_e$, $\lambda_{oin}$ and $\lambda_b$ are measured as follows, thus satisfying the requirement of the formula (5).

$$\lambda_e=24.50 \text{ rad}$$

$$\lambda_{oin}=18.55 \text{ rad} \quad (6)$$

$$\lambda_b=14.00 \text{ rad}$$

Figure 7:
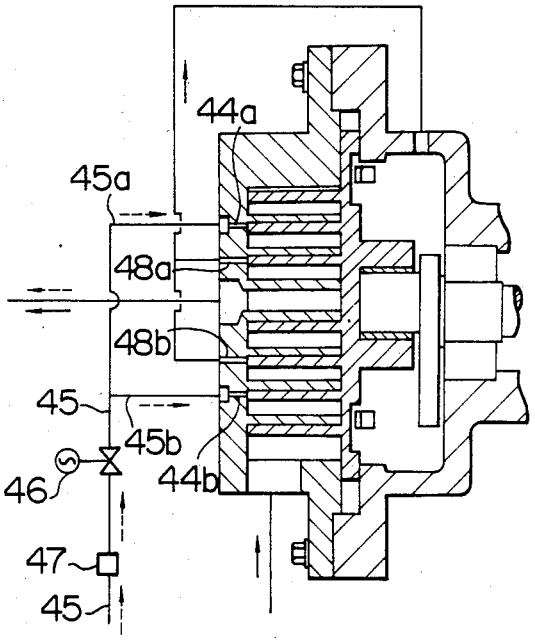
FIG. 7 is a vertical sectional view of the embodiment shown in FIG. 1 applied to a compressor for compressing helium gas.

In the construction of the compressor of FIG. 7 for compressing helium gas, the arrangement of oil injection ports 44a, 44b and gas pressure relieving ports 48a, 48b are the same as those in the above-described embodiments.

In the state after cold start of the compressor, the temperature of the compressor and the temperature of the helium gas are low so that only a small oil injection rate is required as compared with the steady condition.

In FIG. 7, therefore, a solenoid valve 46 is provided in an external oil supply pipe 45 which is connected with pipes 45a and 45b leading from the oil injection ports 44a, 44b and the timing of opening of the solenoid valve 46 is delayed from the timing of starting of the compressor, by the operation of a control circuit (not shown). With this arrangement, it is possible to minimize the amount of oil staying in the enclosed spaces in the machine when the machine is started. In FIG. 7, an orifice 47 is provided with the flow of the gas and the flow of the oil being represented by the solid line and broken line arrows.

The effect of the invention is not substantially changed regardless of whether the oil injection ports and the gas pressure relieving ports are provided in the end plate of the stationary scroll member or in the end plate of the orbiting scroll member. However, the gas pressure relieving ports in particular are preferably formed in the end plate of the stationary scroll member from the view point of facilitating of machining of these ports.

Namely, since the end plate of the orbiting scroll member is provided on its back side with a boss 5c (FIG. 1) for receiving the eccentric pin, the gas pressure relieving ports in some cases have to be formed at an inclination to the axis of the orbiting scroll member, such as to avert the boss. Machining of such inclined ports is rather difficult. On the other hand, the formation of the gas pressure relieving ports in the end plate of the stationary scroll member is rather easy because they can be formed perpendicularly to the plane of the end plate.

Figure 8:
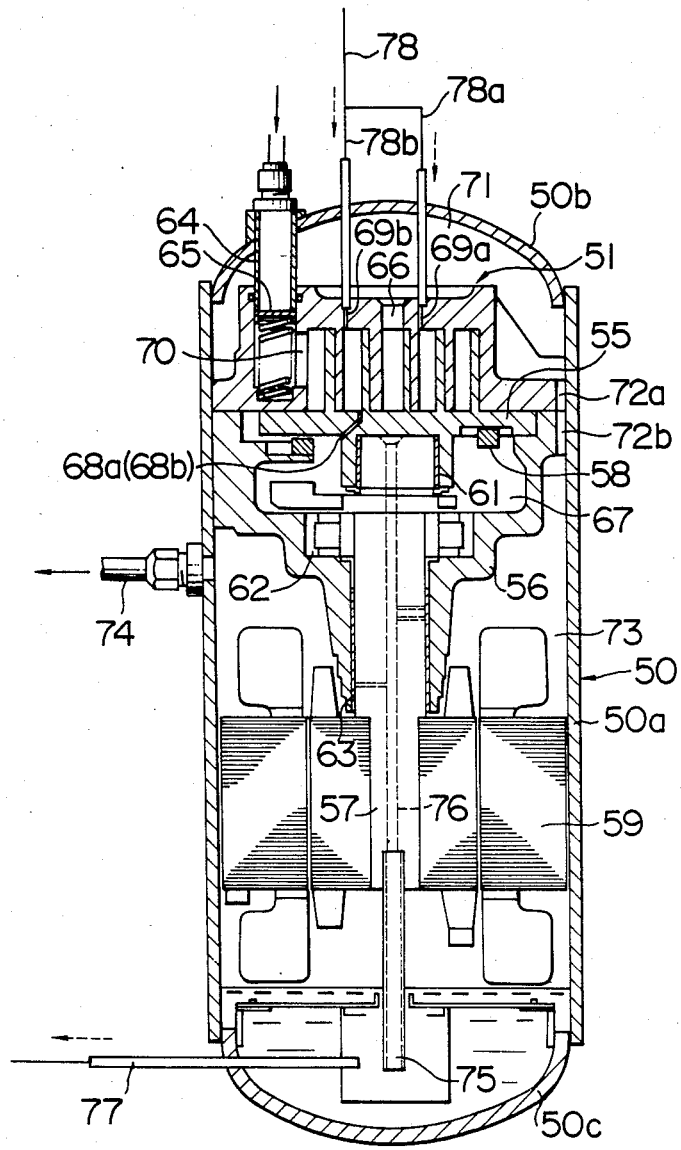
FIG. 8 is a vertical sectional view of a hermetic scroll fluid machine constituting a further embodiment of the invention.
Figure 9:
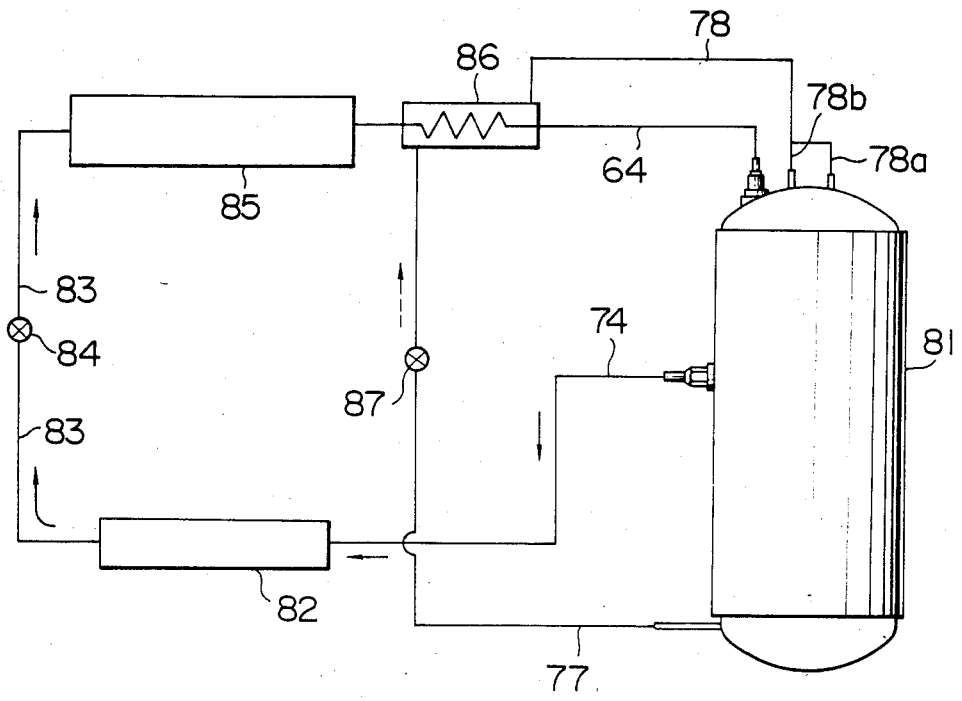
FIG. 9 shows the construction of a refrigeration system incorporating the fluid machine shown in FIG. 8.

FIG. 8 provides an example of an hermetic type machine used as a compressor for a refrigeration unit such as, for example, an air conditioner, and, according to this figure, an hermetic casing 50 is provided including a casing portion 50a, an upper chamber 50b, and a lower chamber 50c. The hermetic casing 50 encases a scroll compressor assembly including a scroll compressor unit disposed in an upper part of the space in the casing 50 and a driving motor unit integral with the compressor unit and disposed in a lower part of the space in the casing 50. The compressor unit includes stationary and orbiting scroll members 51, 55 constituting the compression section, a rotation prevention means 58 for preventing the orbiting scroll member 55 from rotating about its own axis, a main shaft 57, and three bearings in support of the main shaft, namely, an orbiting bearing 61, a main bearing 62 and an auxiliary bearing 63. On the other hand, the driving motor unit has an electric motor 59 having a rotor shaft which is the downward extension of the main shaft 57. The stationary scroll member 51 is fixed to a frame 56.

The stationary scroll member 51 and the orbiting scroll member 55 are constructed in the same manner as shown in FIG. 1. A suction pipe 64, having a check valve 65, is extended vertically into a suction chamber which is formed in a portion of the stationary scroll member outside the wrap portion. A discharge port 66 formed in the center of the stationary scroll member opens into the space in the hermetic casing 50 so that an atmosphere of a pressure equivalent to the discharge pressure of the compressor is maintained inside the hermetic casing 50.

A back pressure chamber 67 is formed on the back surface of the end plate of the orbiting scroll member 55 by a part of the frame 56. Gas pressure introduction ports 68*a*, 68*b* for introducting an intermediate gas pressure into the back pressure chamber 67 are formed in the end plate of the orbiting scroll member, and oil injection ports 69*a*, 69*b* for injecting the oil into the closed spaces under compression stroke are formed in the end plate of the stationary scroll member. The positional relationship between the gas pressure introduction ports 68*a*, 68*b* and the oil injection ports 69*a*, 69*b* is determined substantially in the same manner as that explained before in connection with FIG. 2.

The refrigerant gas of low temperature and pressure is drawn into a suction port 70 through the suction pipe 64 past the check valve 65, and is then drawn into spaces formed between two scroll members and communicating with the suction port 70 as the volume of these spaces is being increased. The drawn gas is then confined as these spaces are isolated from the suction port as a result of the orbital movement of the orbiting scroll member. As the orbiting scroll member further orbits, these spaces are progressively moved towards the center while their volume is decreased so that the gas in these spaces is progressively compressed until it is discharged through the discharge port 66 into the space around the compressor unit within the hermetic container 50.

The thus discharged gas is introduced, through passages 72*a*, 72*b*, into a space 73 around the electric motor 59 and is then delivered outside the machine through a delivery pipe 74.

The gas discharged from the compressor has much oil suspended within it. When the discharged gas comes into the ample space 73 around the electric motor 59, the velocity of the flowing gas is decreased due to expansion so that the oil particles suspended in the gas are allowed to drop by the force of gravity, whereby a natural oil separating effect is attained. The oil thus separated from the refrigerant gas is accumulated and stored in the bottom of the hermetic container. This oil is then sucked up through an oil sucking pipe 75 and an oil passage bore 76 formed in the main shaft by virtue of a pressure differential, and is supplied to respective bearings. After this lubrication, the oil leaks into the back pressure chamber 67. In FIG. 8, solid line arrows show the flow of the gas, while broken line arrows show the direction of flow of the oil.

A part of the oil stored in the bottom of the hermetic casing is then delivered outside the machine through an oil delivery pipe 77 and is injected into the compressor as will be explained later.

The gas of intermediate pressure as obtained at the mid-point of the compression stroke is introduced into the back pressure chamber 67 through the gas pressure introduction ports 68*a*, 68*b*, so as to axially press the orbiting scroll member onto the stationary scroll member.

The oil supplied through pipes 78*a*, 78*b* is lead to the oil injection ports 69*a*, 69*b* and is injected into enclosed spaces formed in the compressor in the compression stroke so as to cool the refrigerant gas which is being compressed. As explained before in connection with FIG. 2, the oil charging ports 69*a*, 69*b* are intermittently communicated with the gas pressure relieving ports 68*a*, 68*b* through the enclosed spaces, so that a part of the injected oil is intermittently introduced into the back pressure chamber 67 thereby effectively cooling the chamber 67.

In addition, the oil filling the compression spaces when the compressor is started or is stopping can intermittently escape into the back pressure chamber 67 through the gas pressure introduction ports 68*a*, 68*b*, so that the tendency for an undesirable abnormal pressure rise to occur due to liquid compression in the compression spaces is suppressed or eliminated.

The delivery pipe 74 of the compressor 81 is connected to a condenser 82 which, in turn, is connected through a pipe 83 equipped with an expansion valve 84 to an evaporator 85. The evaporator 85 is connected to the suction pipe 64 of the compressor 81 through an oil cooler 86.

The oil delivery pipe 77 leading from the bottom of the compressor 81 is connected to the oil cooler 86 through an oil flow rate regulating valve 87. The oil cooler 86 is further connected to the oil injection pipes 78*a*, 78*b* through an oil pipe 78. The oil in the oil delivery pipe 77 is maintained at high temperature and pressure, but the pressure is reduced as the oil flows through the regulating valve 87 which also regulates the oil flow rate. The oil at reduced pressure is cooled in the oil cooler 86 as a result of heat exchange with the refrigerant gas, and is then injected into the compression chamber, i.e., the enclosed spaces, in the compressor through the oil pipe 78 and the oil injection pipes 78*a*, 78*b*. The supply of the oil is effected by a differential pressure between the high pressure maintained in the hermetic container and the pressure in the enclosed spaces into which the oil is injected. Since the oil flow rate regulator 87 is disposed upstream from the oil cooler 86, an atmosphere of the same pressure as the oil injection pressure is maintained inside the oil cooler. In such an arrangement, the oil cooler 86 is required only to have a low withstandable pressure, so that the size and weight of the oil cooler 86 can be advantageously reduced.

What is claimed is:

1. A scroll fluid machine having a stationary scroll member and an orbiting scroll member each having an end plate and a substantially spiral wrap extending from a plane of said end plate, said end plate of said stationary scroll member having a suction port and a discharge port respectively formed in a peripheral and a central portion thereof, said stationary and orbiting scroll members being assembled together with their wraps meshing with each other so as to form enclosed spaces between said wraps, means for enabling said orbiting scroll member to effect an orbital movement with respect to said stationary scroll member without rotating about its own axis whereby the volumes of said enclosed spaces are progressively decreased and a gas is drawn in from said suction port and progressively compressed in said enclosed spaces until the gas is discharged through said discharge port, wherein the improvement comprises: at least one oil injection port formed in said stationary scroll member, and at least one oil relieving passage defined between both scroll members, said oil injection port opening into at least one of said enclosed spaces, a wrap space defined between both scroll members and in a course of forming said one of said enclosed spaces serving for said oil relieving passage for providing an intermittent communication between a suction chamber and said oil injection port, and wherein said oil injection port is positioned in accordance with the following relationship:

$$\lambda e-2\pi<\lambda oin<\lambda e-2\pi+\pi/4,$$

wherein:

$\lambda oin$: position of oil injection port in terms of scroll wrap angle (rad)

$\lambda e$: position of wrapping terminal end of scroll wrap angle (rad)

$\pi$: circumference of circle to diameter ratio.

* * * * *